US006588676B1

(12) United States Patent
Birt et al.

(10) Patent No.: US 6,588,676 B1
(45) Date of Patent: Jul. 8, 2003

(54) CONCRETE RAILROAD GRADE CROSSING PANELS

(75) Inventors: Randall G. Birt, Omaha, NE (US); Thomas L. Egan, Omaha, NE (US)

(73) Assignee: American Concrete Products Co., Omaha, NE (US)

( * ) Notice: Subject to any disclaimer, the term of this patent is extended or adjusted under 35 U.S.C. 154(b) by 0 days.

(21) Appl. No.: 10/103,308

(22) Filed: Mar. 20, 2002

(51) Int. Cl.[7] ..... E01B 1/00
(52) U.S. Cl. ..... 238/8
(58) Field of Search ..... 238/2, 8, 6, 7, 238/379, 381

(56) References Cited

U.S. PATENT DOCUMENTS

| | | | | |
|---|---|---|---|---|
| 1,694,557 | A | | 12/1928 | Oettinger |
| 2,789,771 | A | | 4/1957 | Bishop |
| 2,950,057 | A | | 8/1960 | Speer |
| 3,056,555 | A | | 10/1962 | Eisses |
| 3,066,869 | A | | 12/1962 | Bishop |
| 3,469,783 | A | | 9/1969 | Uralli et al. |
| 3,825,184 | A | | 7/1974 | Hartl |
| 3,863,840 | A | | 2/1975 | Szarka et al. |
| 3,892,356 | A | | 7/1975 | Harmon |
| 3,955,761 | A | | 5/1976 | Szarka et al. |
| 4,093,120 | A | | 6/1978 | Canfield |
| 4,147,304 | A | | 4/1979 | Blyton |
| 4,236,670 | A | | 12/1980 | Limmergard et al. |
| 4,253,605 | A | | 3/1981 | Sims |
| 4,267,969 | A | | 5/1981 | Hales et al. |
| 4,365,743 | A | | 12/1982 | Trickel et al. |
| 4,368,845 | A | | 1/1983 | Perry et al. |
| 4,449,666 | A | | 5/1984 | Hales et al. |
| 4,457,468 | A | | 7/1984 | Hales et al. |
| 4,461,421 | A | | 7/1984 | Maass |
| 4,641,779 | A | | 2/1987 | O'Brien et al. |
| 4,691,863 | A | | 9/1987 | Smith |
| 4,793,545 | A | | 12/1988 | Raymond |
| 4,860,952 | A | | 8/1989 | Schmidt |
| 4,899,932 | A | | 2/1990 | Beachy et al. |
| 4,899,933 | A | | 2/1990 | Martin |
| 4,911,360 | A | | 3/1990 | Spurr |
| 5,096,117 | A | | 3/1992 | Owen |
| 5,181,657 | A | | 1/1993 | Davis |
| 5,464,152 | A | | 11/1995 | Wabnitz |
| 5,535,947 | A | | 7/1996 | Hogue et al. |
| 5,535,948 | A | | 7/1996 | Williams |
| 5,538,182 | A | | 7/1996 | Davis et al. |
| 5,609,294 | A | | 3/1997 | Lucas, Jr. |
| 5,626,289 | A | | 5/1997 | Demers, Jr. et al. |
| 5,655,711 | A | | 8/1997 | Hull et al. |
| 5,740,961 | A | | 4/1998 | Bruning |
| 5,813,602 | A | | 9/1998 | Holland |
| 5,850,970 | A | | 12/1998 | Hull et al. |
| 5,899,379 | A | | 5/1999 | Bruyn et al. |
| 6,068,195 | A | * | 5/2000 | Gaudet ..... 238/8 |
| 6,079,630 | A | | 6/2000 | Schroeder |
| 6,129,288 | A | | 10/2000 | Petersen et al. |
| 6,431,462 | B1 | * | 8/2002 | Apostolou et al. ..... 238/8 |

FOREIGN PATENT DOCUMENTS

| | | |
|---|---|---|
| DE | 1012628 | 7/1957 |
| DE | 2350759 A1 | 4/1975 |
| JP | 2887720 | 5/1994 |
| RU | 2001985 C1 | 10/1993 |

* cited by examiner

*Primary Examiner*—Mark T. Le
(74) *Attorney, Agent, or Firm*—Thomte, Mazour & Niebergall; Dennis L. Thomte

(57) ABSTRACT

A concrete railroad grade crossing comprised of a precast concrete gauge panel extending between the rails and precast concrete approach panels which extend between each rail and the roadway. Elastomeric gauge seals are provided on the opposite sides of the gauge panels for sealing the space between the sides of the gauge panels and the rails. Elastomeric approach seals are provided on the inner ends of the approach panels for engagement with the outer sides of the rails. The inner ends of the seals are at least partially embedded in the associated panels and are additionally held in place by angle members embedded in the panels which are received in slots formed in the seals.

15 Claims, 3 Drawing Sheets

CONCRETE RAILROAD GRADE CROSSING PANELS

BACKGROUND OF THE INVENTION

1. Field of the Invention

This invention relates to an improved concrete railroad grade crossing and more particularly to an improved railroad grade crossing comprising concrete gauge panels which extend between the rails and further comprising concrete approach panels which extend between each rail and the roadway. Even more particularly, the invention relates to improved elastomeric gauge seals which are partially embedded in the sides of the gauge panels and relates to improved elastomeric approach seals which are partially embedded in the inner ends of the approach panels.

2. Description of the Prior Art

Frequently, a railroad track crosses a roadway which necessitates that the space between the rails be filled with a material which brings that space up to grade. It is also necessary to bring the approaches on either side of the rails up to grade. In the past, precast concrete panels, or gauge panels, have been positioned between the rails and precast concrete panels, or approach panels, have been positioned on the approach sides of the track. The prior art railroad grade crossings have also used elastomeric seals on the sides of the concrete gauge panels to fill the space between the gauge panels and the rails to prevent foreign materials from entering and filling the space between the gauge panels and the rail. The prior art railroad grade crossings have also used elastomeric seals on the inner ends of the concrete approach panels to prevent foreign materials from entering and filling the space between the approach panel and the associated rail. In some cases, the upper inner ends of the approach panels and the upper outer ends of the gauge panels were chamfered or beveled to prevent portions of the concrete approach panels and gauge panels from chipping off and filling the spaces between the panels and the rails.

In later years, the gauge seals and approach seals have been partially embedded in the concrete panels to aid in attaching the seals to the panels. However, even where the seals are partially embedded in the prior art concrete panels, it is believed that the prior art devices experience some attachment problems of the seals. Further, it is believed that certain of the prior art devices, even where the seals were partially embedded in the concrete panels, suffered from the problem of the panels crumbling or chipping which resulted in the spaces between the panels and the rails being filled with foreign materials such as concrete particles and which also necessitated that the partially disintegrated panels be replaced.

SUMMARY OF THE INVENTION

A railroad grade crossing for extending a roadway across a pair of parallel spaced-apart rails is disclosed. The railroad grade crossing includes one or more concrete gauge panels which extend substantially between the rails. Each of the gauge panels has a top surface which is substantially coplanar with the roadway with the bottom surface of the gauge panel being supported upon the ties. Each of the gauge panels has an elastomeric gauge seal on each side thereof which are positioned adjacent the rails. The upper ends of the gauge seals are positioned downwardly from the top surface of the gauge panel with the upper ends of the gauge seals having recessed portions formed therein adjacent the outer ends thereof. The lower inner ends of the gauge seals are at least partially embedded in the outer ends of the gauge panels. Concrete approach panels are positioned between each rail and the roadway associated therewith. Each of the concrete approach panels has a top surface which is substantially coplanar with the roadway and a bottom surface which is supported upon the ties. The approach panels have elastomeric approach seals at their inner ends thereof with the upper ends of the approach seals being positioned downwardly from the top surface of the approach panels. The lower outer ends of the approach seals are at least partially embedded in the inner ends of the approach panels. Elongated, metal angle members are embedded in the upper edges of the gauge and approach panels. The gauge and approach seals are provided with grooves or slots extending downwardly thereto which receive the lower ends of associated angle members to aid in securing the seals to the panels.

It is therefore a principal object of the invention to provide an improved concrete railroad grade crossing.

A further object of the invention is to provide an improved concrete railroad grade crossing comprising concrete gauge panels and concrete approach panels wherein elastomeric seals are partially embedded in the panels and extend therefrom so as to be positioned adjacent the rails.

Still another object of the invention is to provide an improved concrete railroad grade crossing including elastomeric gauge seals and approach seals which have voids formed therein so as to reduce the amount of elastomeric material required to construct the same.

Still another object of the invention is to provide an improved concrete railroad grade crossing including concrete gauge and approach panels which have elastomeric seals partially embedded therein.

Still another object of the invention is to provide an improved method of attaching elastomeric gauge and approach seals to gauge panels and approach panels, respectively.

Still another object of the invention is to provide an improved railroad crossing which has greater durability than the railroad grade crossings of the prior art.

These and other objects will be apparent to those skilled in the art.

DESCRIPTION OF THE PREFERRED EMBODIMENT

Figure 1:
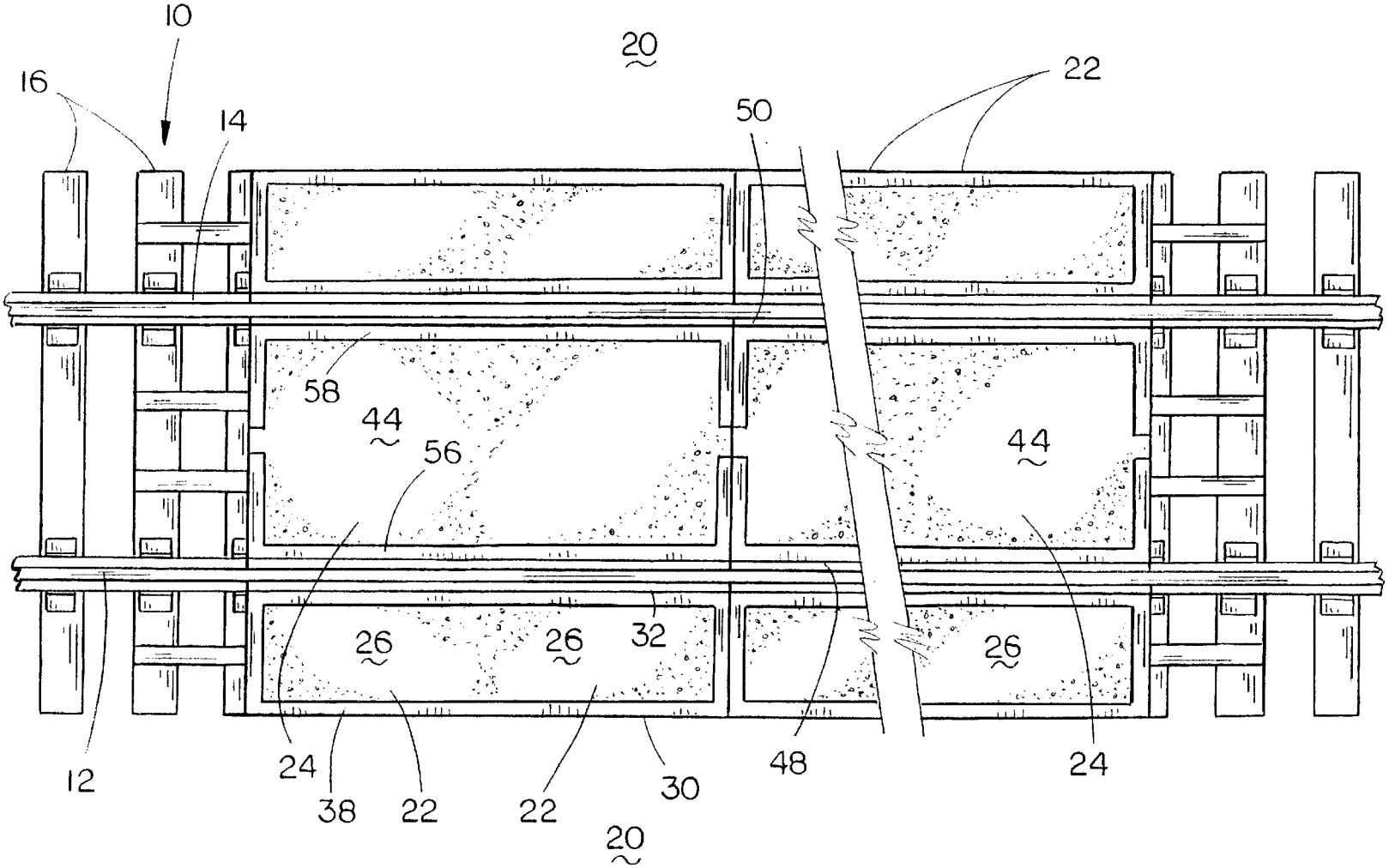
FIG. 1 is a partial top plan view of the concrete railroad grade crossing of this invention.

In the drawings, the numeral 10 refers to a railroad track including rails 12 and 14 which are supported upon a plurality of spaced-apart ties 16 by means of tie plates 18 which are secured to the ties 16 in conventional fashion such as by spikes or bolts. In many cases, the railroad track 10 must cross a roadway which is generally referred to by the reference numeral 20.

Normally, a plurality of precast concrete approach panels 22 will be positioned between the roadway 20 and the rails 12 and 14 with the approach panels 22 being supported upon the outer ends of the ties 16. Normally, the approach panels 22 will be positioned between the roadway 20 and one of the rails in an end-to-end fashion, the number of which will depend upon the width of the roadway and the length of the approach panels. The numeral 24 refers to precast concrete gauge panels which are positioned between the rails 12 and 14 and which are supported upon the ties 16. The gauge panels 24 are supported upon the ties 16 in an end-to-end fashion, the number of which will depend upon the width of the roadway and the length of the gauge panels.

Each of the approach panels 22 is comprised of a precast concrete material and includes top surface 26, bottom surface 28, and opposite sides 30 and 32. Approach panel 22 is provided with a recessed portion 34 formed therein at each of the opposite sides thereof to provide a clearance space for the spikes, bolts, clips, etc., which secure the tie plates 18 to the ties 16 and which secure the rail to the tie plate 18 in conventional fashion.

An elongated, metal angle member 38 is embedded in the approach panel 22 at the upper sides thereof, as illustrated in the drawings, and which is held in place in the concrete by rods or bars 40. As will be explained in more detail hereinafter, an approach seal 42 is secured to the inner end of each of the approach panels 22.

Figure 2:
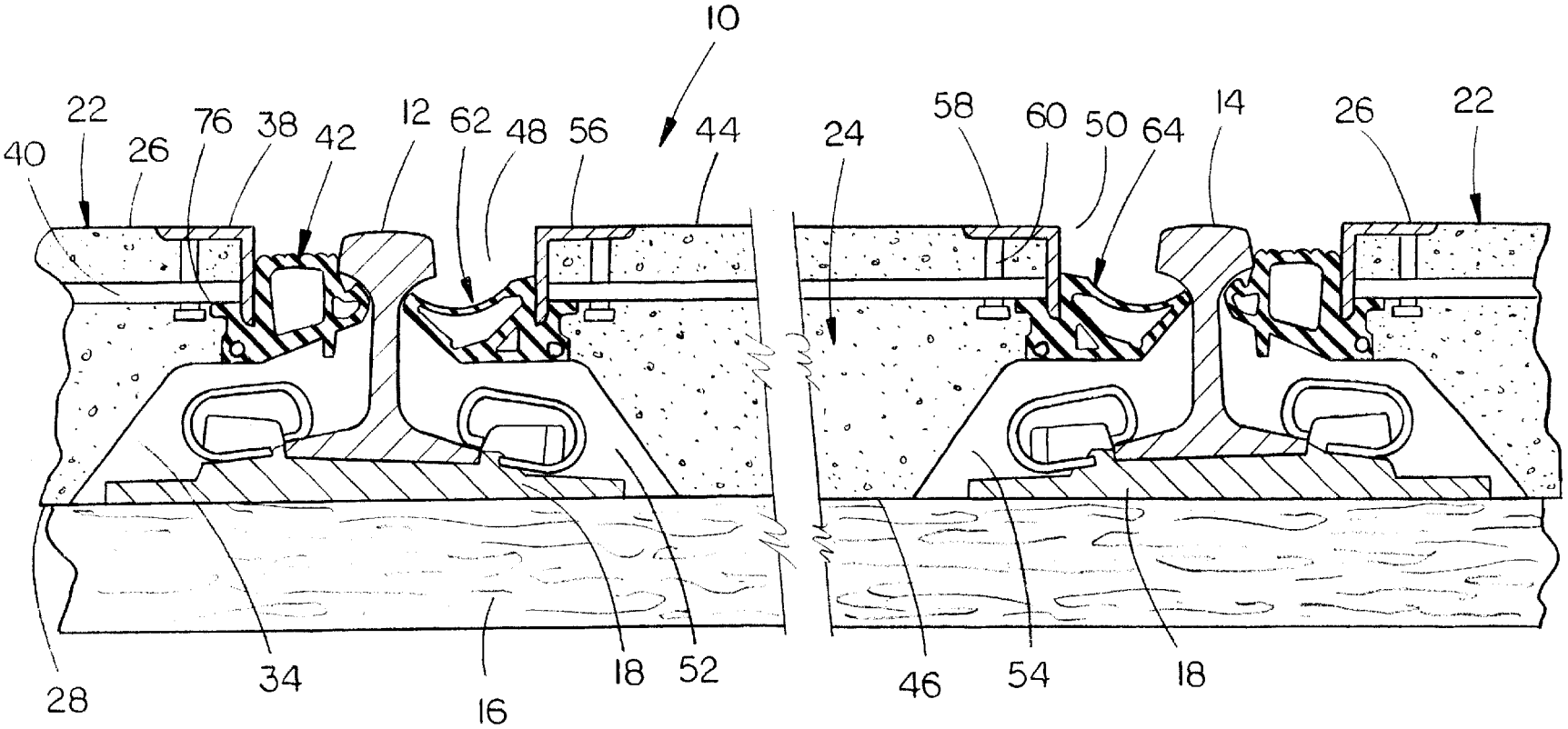
FIG. 2 is a partial vertical sectional view of the concrete railroad grade crossing of this invention.

Each of the gauge panels 24 is comprised of a precast concrete material and includes top surface 44, bottom surface 46, and opposite sides 48 and 50. Gauge panel 24 is provided with a recessed portion 52 at side 48 and is provided with a recessed portion 54 at its side 50, as seen in FIG. 2, to provide a clearance space for the spikes, bolts, clips, etc., which secure the tie plates 18 to the ties 16 and which secure the rails to the tie plates 18 in conventional fashion.

Elongated, metal angle members 56 and 58 are embedded in the gauge panel 24 at the upper sides thereof, as illustrated in the drawings, and which are held in place by rods or bars 60. As will be explained in more detail hereinafter, gauge seals 62 and 64 are secured to the sides of each of the gauge panels 24. Inasmuch as gauge seals 62 and 64 are identical, only gauge seal 62 will be described in detail.

Figure 3:
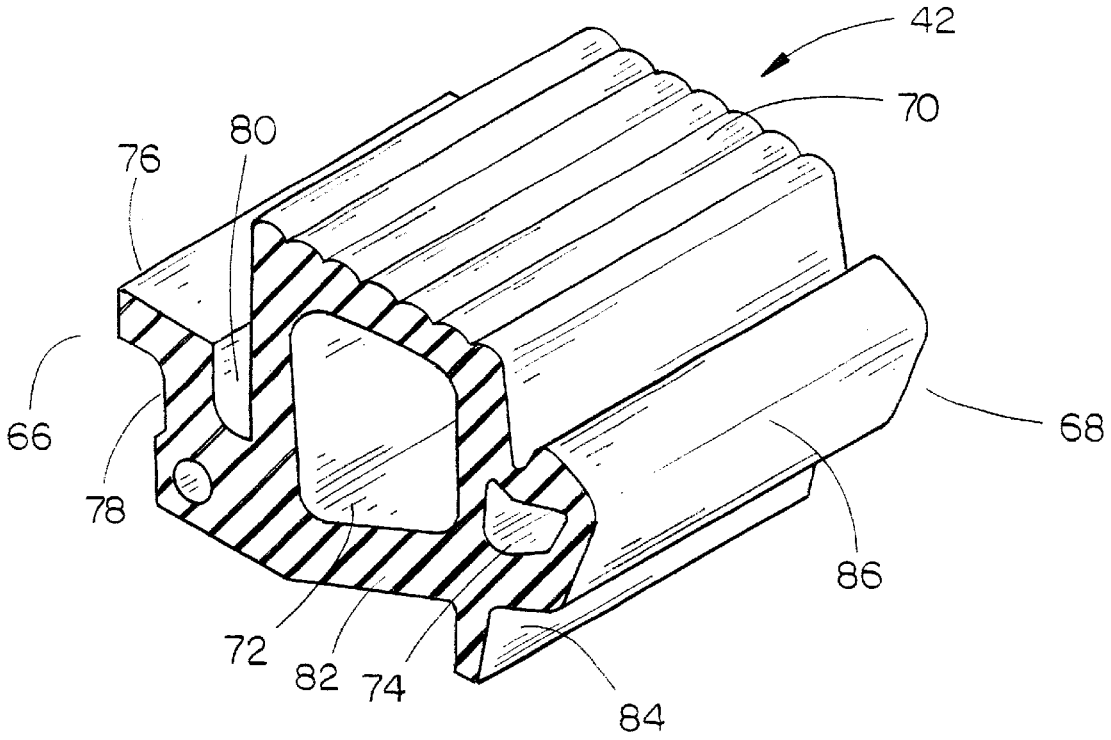
FIG. 3 is a partial perspective view of one of the approach panel seals.

As seen in FIG. 3, approach seal 42 is comprised of an elastomeric material having an outer end 66 and an inner end 68. The upper end 70 of seal 42 is ribbed, as illustrated in FIG. 3, with upper end 70 being positioned below the top surface of the panel 22 and below the upper end of the associated rail. A plurality of elongated voids 72 and 74 are formed in the seal 42 to reduce the amount of material required to fabricate the seal. The inner end 66 of seal 42 has a clip 76 extending therefrom which is embedded in the concrete of the panel 22. Approach seal 42 is also provided with a recessed area 78 formed therein below lip 76 to further aid in embedding the seal in the concrete of the panel 22. The numeral 80 refers to a downwardly extending slot or groove formed in seal 42 inwardly of lip 76 which receives the lower end of the angle member 38 to aid in securing the seal 42 to the panel 22. As seen in FIG. 3, the lower end of seal 42 is tapered upwardly and inwardly at 82 and terminates at a downwardly extending rib 84. The inner end of the seal 42 is arcuate in shape, as best seen in FIG. 3, so provide an arcuate service which is in contact with the arcuate shape of the rail below the head of the associated rail. The engagement of the inner end of the upper end 70 of the seal 42 with the side of the head of the rail 12 and the engagement of the arcuate portion 86 with the side of the rail creates a seal to prevent foreign material such as concrete, rocks, etc., from falling down into the space below the seal 42.

Figure 4:
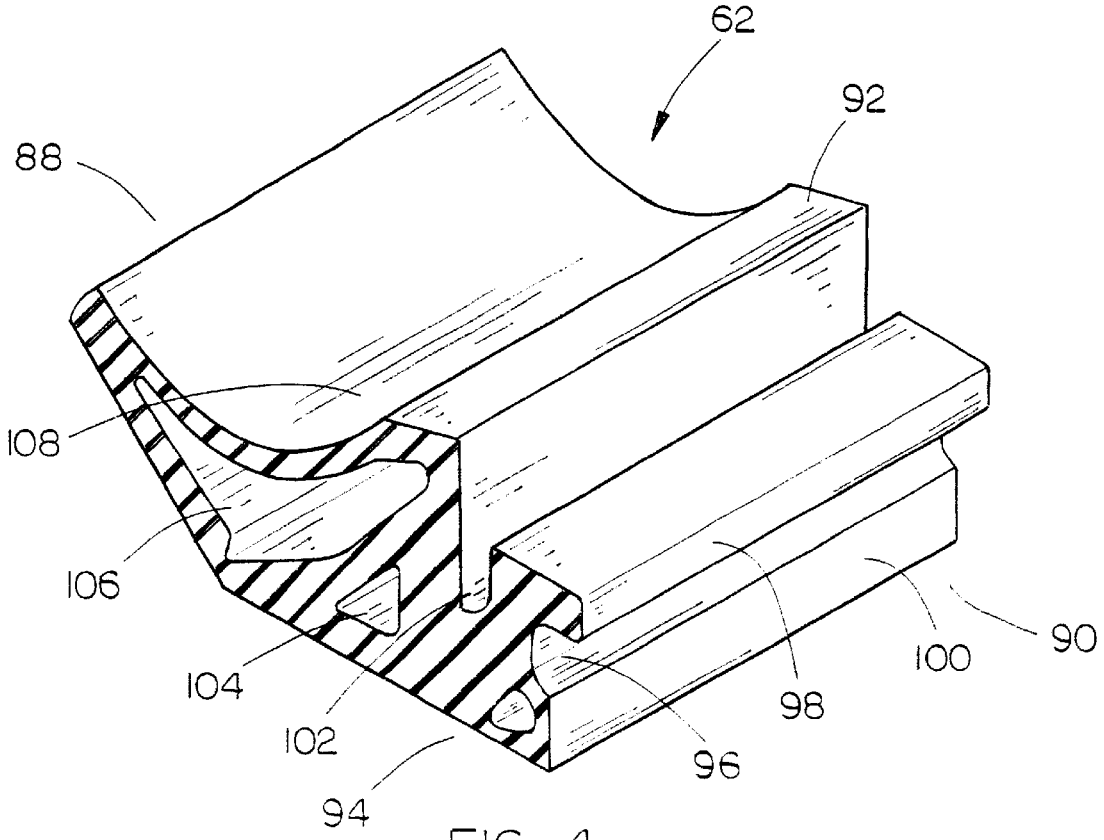
FIG. 4 is a partial perspective view of a gauge panel seal.

As seen in FIG. 4, each of the gauge seals 62 has an outer end 88, inner end 90, upper end 92, and lower end 94. Seal 62 is formed of a suitable elastomeric material and has an arcuate recessed area 96 formed in its inner end to define lips or shoulders 98 and 100 to aid in embedding the seal 62 into the concrete of the gauge panel 24. Seal 62 is provided with a downwardly extending slot or groove 102 which receives the lower end of an angle member 56 to aid in securing the gauge seal 62 to the gauge panel 24. Seal 62 is provided with a plurality of elongated voids 104 and 106 formed therein to reduce the amount of material required to fabricate the seal. Void 106 also creates additional flexibility in the outer end of the seal 62 so that it may flex somewhat so as to be in engagement with the arcuate portion of the inner end of the side of the associated rail. Seal 62 is provided with an arcuate recessed portion 108 formed therein for sealing the flange of the railroad wheels moving along the rails.

The elongated angle members prevent the upper ends of the panels from chipping away or spalling. The angle members also provide a convenient means of attaching the seals to the concrete panels, as previously described. It can therefore be seen that a novel concrete railroad crossing has been provided including approach panels and gauge panels having unique seals associated therewith which prevent foreign materials from entering the space below the seals.

Thus it can be seen that the invention accomplishes at least all of its stated objectives.

We claim:

1. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals having upper and lower ends and inner and outer ends;

said upper ends of said gauge seals being positioned downwardly from said top surface of said gauge panel;

each of said sides of said gauge panel having a recessed portion formed therein in the bottom surface thereof;

said inner ends of said gauge seals being at least partially embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower;

said upper ends of said approach seals being positioned downwardly from said top surfaces of said approach panels;

said outer ends of said approach seals being at least partially embedded in said inner ends of said approach panels;

said inner ends of said approach panels having recessed portions formed therein in the bottom surface thereof;

said opposite sides of said gauge panel having metal angle members cast therein;

each of said angle members of said gauge panel including a vertically disposed portion;

said gauge seals having recessed portions formed therein which partially receive only the lower ends of said vertically disposed portions of said angle members of said gauge panel;

said inner ends of said concrete approach panels having metal angle members cast therein;

each of said metal angle members of said approach panels including a vertically disposed portion;

said approach seals having recessed portions formed therein which partially receive only the lower end of said vertically disposed portions of said angle members of said concrete approach.

2. The railroad crossing of claim 1 wherein each of said gauge and approach seals have voids formed therein.

3. The railroad crossing of claim 1 wherein said top surfaces of said approach seals have ribbed surfaces formed therein.

4. The railroad crossing of claim 2 wherein said voids are elongated.

5. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals having upper and lower ends and inner and outer ends;

said upper ends of said gauge seals being positioned downwardly from said top surface of said gauge panel;

each of said sides of said gauge panel having a recessed portion formed therein in the bottom surface thereof;

said inner ends of said gauge seals being at least partially embedded in said gauge panel at the sides thereof;

said opposite sides of said gauge panel having metal angle members cast therein;

each of said metal angle members of said gauge panel including a vertically disposed portion;

said gauge seals having recessed portions formed therein which partially receive only the lower end of said vertically disposed portions of said angle members of said gauge panel.

6. The railroad crossing of claim 5 wherein said gauge seals have voids formed therein.

7. The railroad crossing of claim 6 wherein said voids are elongated.

8. An approach panel for a railroad grade crossing for extending a roadway across a pair of parallel, spaced-apart rails which are supported upon spaced-apart ties, comprising:

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower;

said upper ends of said approach seals being positioned downwardly from said top surfaces of said approach panels;

said outer ends of said approach seals being at least partially embedded in said inner ends of said approach panels;

said inner ends of said approach panels having recessed portions formed therein in the bottom surface thereof;

said inner ends of said concrete approach panels having metal angle members cast therein;

each of said metal angle members of said approach panel including a vertically disposed portion;

said approach seals having recessed portions formed therein which partially receive only the lower end of said vertically disposed portions of said angle members of said concrete approach.

9. The approach panel structure of claim 8 wherein said approach seals have voids formed therein.

10. The approach panel of claim 8 wherein said top surfaces of said approach seals have ribbed surfaces formed therein.

11. The approach panel of claim 9 wherein said voids are elongated.

12. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals having upper and lower ends and inner and outer ends;

said upper ends of said gauge seals being positioned downwardly from said top surface of said gauge panel;

each of said sides of said gauge panel having a recessed portion formed therein in the bottom surface thereof;

said inner ends of said gauge seals being at least partially embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower end;

said outer ends of said approach seals being at least partially embedded in said inner ends of said approach panels;

said inner ends of said approach panels having recessed portions formed therein in the bottom surface thereof;

said opposite sides of said gauge panel having metal angle members cast therein;

each of said metal angle members of said gauge panel including a vertically disposed portion;

said gauge seals having recessed portions formed therein which partially receive only the lower end of said vertically disposed portions of said angle members of said gauge panel;

said inner ends of said concrete approach panels having metal angle members cast therein;

each of said metal angle members of said approach panels including a vertically disposed portion;

said approach seals having recessed portions formed therein which partially receive only the lower end of said vertically disposed portions of said angle members of said concrete approach.

13. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals having upper and lower ends and inner and outer ends;

each of said sides of said gauge panel having a recessed portion formed therein in the bottom surface thereof;

said inner ends of said gauge seals being at least partially embedded in said gauge panel at the sides thereof;

said opposite sides of said gauge panel having metal angle members cast therein;

each of said metal angle members of said gauge panel including a vertically disposed portion;

said gauge seals having recessed portions formed therein which partially receive only the lower ends of said vertically disposed portions of said angle members of said gauge panel.

14. An approach panel for a railroad grade crossing for extending a roadway across a pair of parallel, spaced-apart rails which are supported upon spaced-apart ties, comprising:

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower end;

said outer ends of said approach seals being at least partially embedded in said inner ends of said approach panels;

said inner ends of said approach panels having recessed portions formed therein in the bottom surface thereof;

said inner ends of said concrete approach panels having metal angle members cast therein;

each of said metal angle members of said approach panels including a vertically disposed portion;

said approach seals having recessed portions formed therein which partially receive only the lower ends of said vertically disposed portions of said angle members of said concrete approach.

15. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals having upper and lower ends and inner and outer ends;

said upper ends of said gauge seals being positioned downwardly from said top surface of said gauge panel;

each of said sides of said gauge panel having a recessed portion formed therein in the bottom surface thereof;

said inner ends of said gauge seals being at least partially embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower end;

said outer ends of said approach seals being at least partially embedded in said inner ends of said approach panels;

said inner ends of said approach panels having recessed portions formed therein in the bottom surface thereof;

said opposite sides of said gauge panel having gauge angle members cast therein;

said gauge angle members having first and second legs and being generally L-shaped; said first legs being cast in said top surface of said gauge panel; said second leg being vertically disposed;

said gauge seals having recessed portions formed therein which partially receive only the lower ends of said vertically disposed second leg of said gauge angle members;

said inner ends of said concrete approach panel having approach angle members cast therein;

said approach angle members having first and second legs and being generally L-shaped; said first legs being cast in said top surface of said approach panel; said second leg being vertically disposed;

said approach seals having recessed portions formed therein which partially receive only the lower ends of said vertically disposed second leg of said approach angle members.

* * * * *